United States Patent [19]

Feess et al.

[11] 4,314,811

[45] Feb. 9, 1982

[54] TWO-PHASE PRINTING PROCESS FOR PREPARING CONVERSION ARTICLES AND DISCHARGE RESIST PRINTS

[75] Inventors: Erich Feess, Hofheim am Taunus; Friedrich Reinhardt, Bad Soden am Taunus, both of Fed. Rep. of Germany

[73] Assignee: Hoechst Aktiengesellschaft, Fed. Rep. of Germany

[21] Appl. No.: 165,028

[22] Filed: Jul. 1, 1980

[30] Foreign Application Priority Data

Nov. 8, 1979 [DE] Fed. Rep. of Germany ..... 2945095

[51] Int. Cl.[3] ..... D06P 5/15

[52] U.S. Cl. ..... 8/457; 8/449; 8/461; 8/463; 8/465; 8/592; 8/640; 8/642; 8/918

[58] Field of Search ..... 8/449, 461, 465, 592, 8/918, 457, 463, 642

[56] References Cited

U.S. PATENT DOCUMENTS

| | | | |
|---|---|---|---|
| 2,164,930 | 7/1939 | Lubs | 8/592 |
| 3,700,402 | 10/1972 | Noda et al. | 8/592 |
| 4,240,791 | 12/1980 | Sato et al. | 8/465 |
| 4,244,690 | 1/1981 | Sato et al. | 8/465 |

FOREIGN PATENT DOCUMENTS

| | | |
|---|---|---|
| 52/5384 | 1/1977 | Japan . |
| 829443 | 3/1960 | United Kingdom . |
| 936644 | 9/1963 | United Kingdom . |

*Primary Examiner*—A. Lionel Clingman
*Attorney, Agent, or Firm*—Connolly and Hutz

[57] ABSTRACT

According to two-phase processes multi-color effects are obtained on cellulosic materials, namely conversion effects with reactive and vat dyestuffs on the one hand and discharge resists prints with reactive dyestuffs and, optionally, vat dyestuffs on the other hand, by printing or padding the reactive dyestuff or a mixture of reactive and vat dyestuffs in a weakly acidic medium onto the material, overprinting this material with a neutral paste containing formamidine sulfinic acid as discharging agent and, if desired, a vat dyestuff, drying the print, contacting the material with an aqueous strongly alkaline liquor, steaming it and finishing the article in known manner, depending on the choice of dyestuffs.

7 Claims, No Drawings

TWO-PHASE PRINTING PROCESS FOR PREPARING CONVERSION ARTICLES AND DISCHARGE RESIST PRINTS

CROSS-REFERENCE TO RELATED APPLICATION

Patent application Ser. No. 165,029 of even filing date relates to two-phase printing processes for preparing conversion articles with reactive and vat dyestuffs and discharge resist prints with reactive and optionally vat dyestuffs on cellulosic materials, which comprises printing or padding the material with a weakly acidic printing paste or padding liquor containing the reactive dyestuff or a mixture of reactive and vat dyestuffs, overprinting the material with a neutral printing paste containing a stable reducing agent of the sulfinic acid series and, if desired, a vat dyestuff, drying the material, contacting it with an aqueous strongly alkaline liquor, steaming it and finishing the article. The preferred reducing agent is sodium formaldehyde sulfoxylate and the alkaline liquor preferably contains a cyano or diacetyldioxime complex or iron, copper, chromium, manganese, cobalt or nickel as a catalyst.

It now has been found that especially favorable results are obtained when the reducing agent is formamidine sulfinic acid (thiourea dioxide). With this reducing agent no metal complex is necessary.

In textile printing, contrary to paper printing, where the autotype polychromic technique prevails, the preparation of multicolored articles requires extremely high costs, for a separate roll or screen is necessary for each shade, except overprint areas. It is therefore especially advantageous to increase the number of shades contained in a print pattern in a different way, for example by conversion printing.

In conversion printing the fiber materials to be colored are printed with slightly acidic printing pastes containing mixtures of reactive and vat dyestuffs, then submitted to an intermediate drying step or suitably overprinted in the same process step in wet state with neutral printing colors which contain formamidine sulfinic acid as reducing agent which is stable under the conventional drying conditions, in an amount of from 100 to 200 g per kg of printing paste. After drying, the printed material is passed through a strongly alkaline liquor containing e.g. from 100 to 200 g of a 32.5% by weight sodium hydroxide solution per liter of liquor or equivalent quantities of sodium or potassium carbonate or of water glass, and subsequently treated for about 5 to 30 seconds, preferably for 10 to 20 seconds, with saturated steam or overheated steam.

The dyestuffs may alternatively be applied in a different way, for example by padding or nip-padding. The alkali may alternatively be applied to the print in a different way, for example by nip-padding or spraying.

The term "weakly acidic" implies that the printing paste or the padding liquor has a pH which is sufficiently low as to ensure that the reactive dyestuff is not fixed on the cellulose. This "threshold" pH value depends on the dyestuff and the physical conditions applied but is generally in the range of 5 to 6.5. Sodium dihydrogenphosphate is especially appropriate to adjust this pH range.

In the said process, the reactive dyestuff is fixed only on the areas printed with dyestuff mixture and which have not been overprinted with the reducing agent, while the reactive dyestuff is discharged and the vat dyestuff is developed whereever the material has been contacted with the reducing agent.

A prerequisite of this known procedure is that the reducing agent used on the one hand is stable under the drying conditions and on the other hand is capable of reacting so rapidly that the vat dyestuffs can be fixed within a short steaming period. This steaming period must not be exceeded to prevent a damaging of the reactive dyestuffs, for in a longer steaming period the bond between the dyestuff and the fiber would be destroyed owing to the great quantities of alkali present in the padding liquor.

Owing to the weakly acidic reaction of formamidine sulfinic acid (pH of about 3), the printing pastes are suitably prepared with the addition of locust bean flour derivatives instead of the usually employed alginates in admixture with starch ethers or the pH is suitably shifted in the direction of the neutral point by adding an alkali.

The technique described hereinbefore can be applied in accordance with the present invention to the discharge printing by dividing the original dyestuff application into two steps, that means that the cellulosic material is printed with a printing paste containing one or several reactive dyestuffs or padded or nip-padded with a liquor, subsequently dried and printed with a printing paste, in the manner described for the conversion article, formamidine sulfinic acid as reducing agent and optionally one or several vat dyestuffs having been added to this paste. The rest of the printing procedure is run in analogous manner as the process specified hereinbefore. Ground colors and optionally colors for illuminated discharge prints are fixed during the short steaming period after the material has passed through the alkaline liquor.

Owing to the fact that the procedure specified hereinbefore is a discharge resist process, the reactive coloration has not to be submitted to a finishing operation, which makes the process less expensive.

An addition of hygroscopic substances, such as glycerol, in sufficient amounts to the hitherto employed discharge printing pastes, for example in the classical sulfoxilate process, can be dispensed with in the process according to the invention which involves a satisfactory take up of humidity in the course of the passage through the alkaline padding liquor prior to steaming.

A further advantageous feature of the process of the invention is that the discharge prints after printing, do not have to be deposed and optionally cooled, which step is necessary in the conventional single-stage discharge printing processes for safety reasons, on the contrary, the prints can be submitted to the further treatment steps in completely continuous manner.

Finally the stability of the printing colors and of the prints prior to steaming, when using certain vat dyestuffs, is distinctly higher than in the conventional discharge printing process using alkali and printing colors containing a reducing agent.

This novel method of preparing discharge prints, consequently, involves the following characterisitc features:

1. the discharge resist technique,
2. the activation of a reducing agent stable under drying conditions and, thereby,
3. the possible application of the two-phase technique with short-time steaming.

Suitable reactive dyestuffs for the process according to the present invention both for a conversion article and for a discharge print can derive from different organic dyestuff classes, for example azo, anthraquinone or phthalocyanine compounds and should contain at least one reactive group selected from the following radicals: β-hydroxyethylsulfone-sulfuric acid ester, vinylsulfonyl, monochlorotriazine, dichlorotriazine, 2,2,3,3-tetrafluorocyclobutane-1-acryloylamino, vinylsulfonylamino, β-hydroxyethylsulfonylamino-sulfuric acid ester, β-phenylsulfonylpropionylamino or 2,3-dichloroquinoxaline, monofluorotriazine, 2,4-dichloroquinazoline, 1,4-dichlorophthalazine, alkylsulfonylpyrimidine, tri- or tetrachloropyrimidine, 2,4-difluoro-5-chloropyrimidine or 1-aryl-4,5-dichloropyridazone. Preference is given to dyestuffs that contain a vinylsulfonyl group or a precursor thereof.

The vat dyestuffs may belong to the series of the anthraquinone, indigo and naphthoquinone dyes or be derivatives of naphthalenetetracarboxylic acid.

Suitable materials for the process according to the invention are all substrates of cellulosic origin, that means native products such as cotton or linen or regenerated cellulose fibers such as rayon stable fibers or viscose and highly water-resistant variants thereof.

The following examples illustrate the invention. Percentages are by weight. The Colour Index numbers specified in the examples have been taken from the Colour Index, 2nd edition (1956) and from the supplement thereof (1963).

EXAMPLE 1

A cotton fabric is printed with a printing paste obtained as follows:

18 g of the commercial powder composition of the reactive dyestuff of the formula

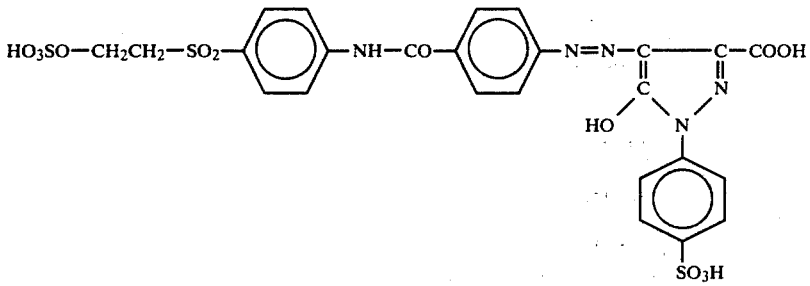

30 g of the commercial powder composition of the reactive dyestuff C.I. 17757 and 12 g of the commercial powder composition of the reactive dyestuff of the formula

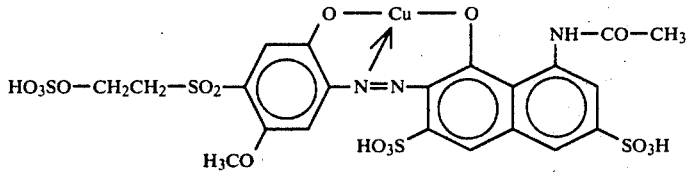

120 g of the commercial paste composition of the vat dyestuff of the formula

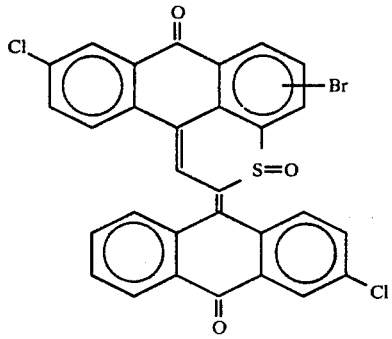

are dissolved or dispersed in 200 g of hot water and the resulting solution or dispersion is introduced into 500 g of a mixture consisting of 2 parts of a 4% aqueous sodium alginate solution and 1 part of a 10% aqueous sodium starch glycolate solution.

To the product there are added 7 g of sodium meta-nitrobenzene sulfonate, 3 g of sodium dihydrogenphospate and 110 g of water or thickener to complete the weight to 1,000 g.

The printed fabric is overprinted in the same process step in wet state with a printing paste containing 160 g of formamidine sulfinic acid in 600 g of a 5% aqueous solution of locust bean flour glycolate. The material dried under mild conditions is subsequently passed through an immersion bath containing 100 g/l of a 32.5% sodium hydroxide solution and immediately thereafter to a steamer where it is treated for 10 seconds with saturated steam. Thereafter the print is thoroughly rinsed with cold water, treated at 40° to 50° C. in a bath containing 2 g/l of hydrogen peroxide and 5 ml/l of acetic acid, anew rinsed, washed with 0.5 g/l of a sodium oleyl-N-methyltauride at 90° C., rinsed and dried.

A print consisting of dark brown and yellow-green shades is obtained having good fastness properties.

EXAMPLE 2

A knitted fabric made from rayon stable fibers is printed, in the manner specified in Example 1, with a printing paste having the composition as described there but containing 40 g of the commercial powder composition of the reactive dyestuff C.I. No. 18105 and 130 g of the commercial paste composition of the vat dyestuff C.I. No. 69840, instead of the dyestuffs specified in Example 1.

The printed material is submitted to the after-treatment and finishing procedure specified in Example 1.

The print pattern consisting of red and blue shades is obtained having good fastness properties.

EXAMPLE 3

A cotton cretonne is padded on a padding mangle, with a squeeze off effect of 100%, with a dyeing liquor containing per liter 50 g of the commercial powder composition of the reactive dyestuff C.I. No. 20505, 7 g of sodium meta-nitrobenzene sulfonate, 3 g of sodium dihydrogenphosphate and 100 g of a 6% aqueous sodium alginate solution.

The padded and dried fabric is printed with a printing paste of pH 6–7 which has been obtained as follows:

| | |
|---|---|
| 100 g | of the commercial paste composition of the vat dyestuff C.I. No. 59105 are dispersed in |
| 150 g | of water, to the resulting dispersion there are added |
| 20 g | of a 32.5% sodium hydroxide solution and the product is introduced into |
| 500 g | of a thickener mixture as specified in Example 1. To the mixture there are added |
| 120 g | of formamidine sulfinic acid and |
| 100 g | of water or thickener to complete the weight to |
| 1,000 g. | |

The material printed and dried under mild conditions is padded, with a liquor take up of 100%, with a liquor containing per liter 100 g of a 32.5% sodium hydroxide solution and immediately thereafter treated with saturated steam for 10 seconds. Next, the material is rinsed with cold water, treated at 40° to 50° C. in a bath containing 2 g/l of hydrogen peroxide and 5 ml/l of acetic acid, anew rinsed, washed with 0.5 g/l of sodium oleyl N-methyltauride at 90° C., rinsed and dried.

A gold-yellow print on a black ground is obtained having good fastness properties.

EXAMPLE 4

A fabric made from highly water-resistant regenerated cellulose fibers is padded, in the manner specified in Example 3, with a liquor containing per liter 40 g of the commercial powder composition of the reactive dyestuff of the formula

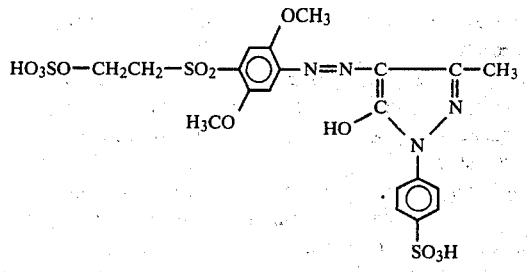

instead of the dyestuff specified in Example 3, the material is dried and subsequently printed with a printing paste obtained as follows:

| | |
|---|---|
| 120 g | of the commercial paste composition of the vat dyestuff C.I. No. 73360 are dispersed in |
| 150 g | water and the resulting dispersion is introduced with agitation into |
| 500 g | of a mixture consisting of<br>2 parts of a 5% aqueous solution of a locust bean flour glycolate and<br>1 part of a 10% aqueous sodium starch glycolate solution |
| 100 g | of formamidine sulfinic acid are added and finally |
| 130 g | of water or thickener to complete the weight to |
| 1,000 g. | |

The fabric is aftertreated in the manner specified in Example 3.

A pink print on a gold-yellow ground is obtained having good fastness properties.

EXAMPLE 5

A fabric made from rayon stable fibers is nip-padded in the manner specified in Example 3 with a liquor containing per liter 30 g of the commercial powder composition of the reactive dyestuff of the formula

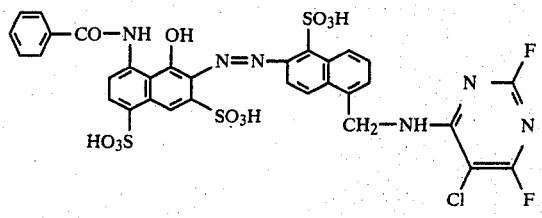

instead of the dyestuff specified in Example 3.

The dried material is subsequently printed with a printing paste having the composition as specified in Example 3, except that is contains as the dyestuff 150 g of the commercial paste composition of the vat dyestuff No. C.I. 68420.

The printed material is dried under mild conditions and subsequently padded, with a liquor take up of 90%, with a liquor containing per liter 100 g of a 32.5% sodium hydroxide solution and 50 g of sodium carbonate, steamed with saturated steam for 10 seconds and after-treated in the manner specified in Example 3.

A yellow print on a brilliant red ground is obtained having good fastness properties.

We claim:

1. A two-phase process for preparing conversion articles with reactive and vat dyestuffs or discharge resist prints with reactive dyestuffs or a mixture of reactive and vat dyestuffs on cellulosic materials, which comprises (a) printing or padding the material with a weakly acidic printing paste or padding liquor containing the reaction dyestuff or the mixture of reactive and vat dyestuffs, (b) overprinting the material with a neutral printing paste containing formamidine sulfinic acid, (c) drying the material, (d) contacting the material with an aqueous strongly alkaline liquor, (e) steaming the material and (f) finishing the article.

2. A process as claimed in claim 1, wherein the neutral printing paste contains a vat dyestuff.

3. A process as claimed in claim 1, wherein steaming is performed for 5 to 30 seconds with saturated steam.

4. A process as claimed in claim 1, wherein the weakly acidic printing paste or padding liquor contains sodium dihydrogenphosphate.

5. A process as claimed in claim 1, wherein the strongly alkaline liquor contains an alkali metal hydroxide, carbonate or silicate.

6. A process as claimed in claim 1, wherein the strongly alkaline liquor is applied by passing the material through said liquor or, by spraying or padding the material.

7. A process as claimed in claim 1, wherein the cellulosic material consists essentially of native or regenerated cellulose fibers or of a mixture of such fibers.

* * * * *